United States Patent [19]

Raasch et al.

[11] Patent Number: 4,516,397

[45] Date of Patent: May 14, 1985

[54] METHOD AND DEVICE FOR INCREASING THE HAIRINESS AND THE BULKINESS OF A THREAD

[75] Inventors: Hans Raasch; Heinz-Georg Wassenhoven, both of Monchen-Gladbach, Fed. Rep. of Germany

[73] Assignee: W. Schlafhorst & Co., Monchen-Gladbach, Fed. Rep. of Germany

[21] Appl. No.: 499,193

[22] Filed: May 31, 1983

[30] Foreign Application Priority Data

May 29, 1982 [DE] Fed. Rep. of Germany ..... 3220402

[51] Int. Cl.[3] ..... D01H 7/882

[52] U.S. Cl. ..... 57/417; 57/354; 57/415

[58] Field of Search ..... 57/400, 404, 415–417, 57/352, 354

[56] References Cited

U.S. PATENT DOCUMENTS

| | | | |
|---|---|---|---|
| 3,789,597 | 2/1974 | Schon | 57/417 |
| 3,834,147 | 9/1974 | Havranek et al. | 57/417 |
| 4,011,712 | 3/1977 | Egbers et al. | 57/417 |
| 4,258,541 | 3/1981 | Le Chatelier et al. | 57/417 |
| 4,385,488 | 5/1983 | Raasch et al. | 57/417 |

*Primary Examiner*—John Petrakes

*Attorney, Agent, or Firm*—Herbert L. Lerner; Laurence A. Greenberg

[57] ABSTRACT

A method of increasing the hairiness and bulkiness of a thread, in an open-end rotor spinning machine having a deflection ring disposed concentric to the axis of rotation of the rotor, includes forming a false twist in the thread with the deflection ring, continuously withdrawing the thread through the deflection ring substantially along the direction of the axis of rotation of the rotor, dissolving the false twist in the thread, forming a thread balloon with the thread, bringing the thread in contact with a multiplicity of separately disposed balloon disturbance elements, and changing the diameter of the thread balloon several times during each revolution of the thread balloon, and a device for carrying out the method.

14 Claims, 8 Drawing Figures

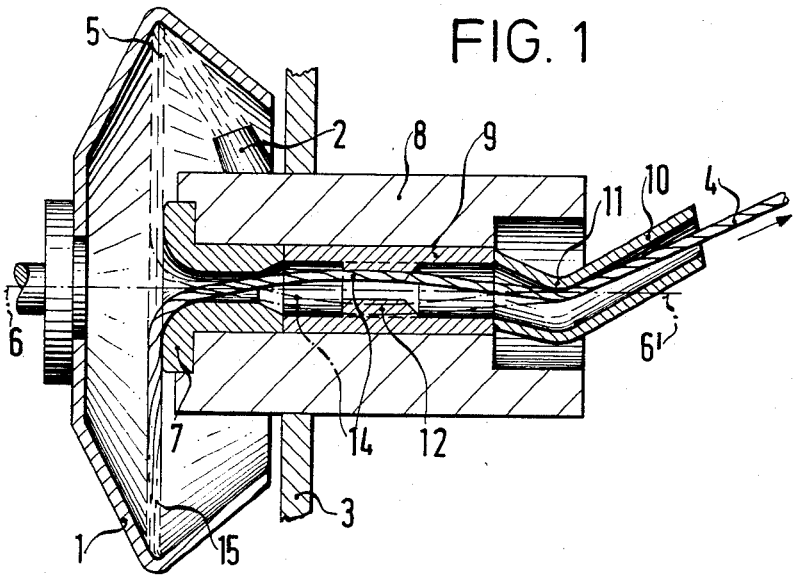
FIG. 1
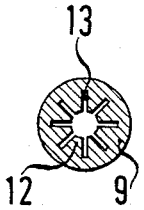
FIG. 2
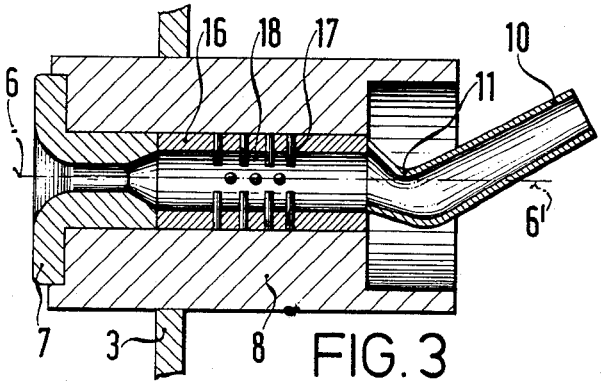
FIG. 3
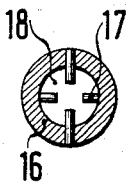
FIG. 4
FIG. 5
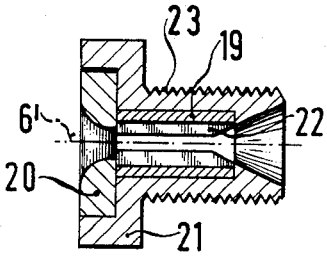

METHOD AND DEVICE FOR INCREASING THE HAIRINESS AND THE BULKINESS OF A THREAD

The invention relates to a method and device for increasing the hairiness or hairy texture and the bulkiness or voluminousness of a thread which is continuously drawn approximately in the direction of the axis of rotation of the rotor of an open-end rotor spinning machine, through a deflection ring disposed concentric to the rotor axis.

Threads produced in open-end rotor spinning machines are distinguished from threads manufactured in ring spinning machines, by the fact that they have a much less hairy texture and have much less bulk, i.e. they are less voluminous. For many textile products, such as fabrics, this is an advantage.

However, in the case of knitted and woven goods, a soft material texture is required, depending on the application. This soft texture cannot be achieved with "rotor-yarn" as well as it is with "ring-yarn".

It is accordingly an object of the invention to provide a method and device for increasing the hairiness and bulkiness of a thread, which overcomes the hereinaforementioned disadvantages of the heretofore-known devices of this general type, and to produce a thread in an open-end rotor spinning machine which has a hairiness and bulk similar to a thread which was produced in a ring spinning machine. The "handle" of the finished goods should also be comparable to the handle of a material which was produced from ring-spun threads.

With the foregoing and other objects in view there is provided, in accordance with the invention, a method of increasing the hairiness and bulkiness or volume of a thread, in an open-end rotor spinning machine having a deflection ring disposed concentric to the axis of rotation of the rotor, which comprises forming a false twist in the thread with the deflection ring, continuously withdrawing the thread through the deflection ring substantially along the direction of the axis of rotation of the rotor, dissolving the false twist in the thread, forming a thread balloon with the thread, bringing the thread in contact with a multiplicity of separately disposed balloon disturbance elements, and changing the diameter of the thread balloon several times during each revolution of the thread balloon.

In accordance with another mode of the invention, there is provided a method which comprises forming the thread balloon during or after the dissolution of the false twist.

In accordance with a further mode of the invention, there is provided a method which comprises abruptly changing the peripheral velocity of the thread balloon several times during each revolution of the thread balloon.

In accordance with an added mode of the invention, there is provided a method which comprises alternatingly moving the thread at least to the vicinity of the axis of the thread balloon and back to the outermost edge of the thread balloon, during the formation of the thread balloon.

In order to carry out the method, there is provided a device for increasing the hairiness and bulkiness of a thread in an open-end rotor spinning machine, having a rotor with an axis of rotation and a deflection ring disposed concentric to the axis of rotation of the rotor, the thread being continuously drawn through the deflection ring substantially along the direction of the axis of rotation of the rotor, the improvement comprising a thread balloon guide connected to the deflection ring for forming a thread balloon, the thread balloon guide having annular separately disposed balloon disturbance elements for contacting the thread.

In accordance with an additional feature of the invention, there is provided a thread navel, the deflection ring being disposed in the thread navel and the thread balloon guide being in the form of a tubular insert disposed in the thread navel.

In accordance with again another feature of the invention, the balloon disturbance elements are in the form of projections, elevations or raised portions formed on the thread balloon guide in alignment with the longitudinal axis of the thread balloon guide.

In accordance with again a further feature of the invention, the thread balloon guide has depressions or recesses formed therein between the balloon disturbance elements, for determining the largest possible balloon diameter and rest positions for receiving the thread for limited durations.

In accordance with again an added feature of the invention, the projections and the depressions have ends disposed on respective imaginary cylindrical surfaces, and the surfaces have diameters in a mutual ratio of between 1:3 and 2:3.

In accordance with again an additional feature of the invention, the deflection ring has an inner diameter being larger than the distance between oppositely disposed balloon disturbance elements.

In accordance with yet another feature of the invention, there is provided a thread centering device disposed along the thread withdrawal direction from the thread balloon guide, for permitting a centralized withdrawal of the thread.

In accordance with a concomitant feature of the invention, the deflection ring has a given inner diameter, the projections have ends lying on a diameter being smaller than the given inner diameter of the deflection ring, and the depressions have ends lying on a diameter being greater than the given inner diameter of the deflection ring.

The thread, which is already finished itself, receives an additional after treatment, but this is done in such a manner that the treatment is still performed within the spinning unit, before the thread is pulled out with the aid of rollers through a discharge tube or a similar device.

The deflection ring imparts a false twist to the thread, although the twist is already loosened in vicinity of the deflection ring. According to the invention, during or after the loosening of the false twist, the thread is forced to form a thread balloon. This can be effected in different ways. For example, the formation of the balloon can be induced by the centrifugal forces on the thread. However, the balloon can also be formed by the balloon disturbance elements, which contact the thread downstream of the deflection ring. These balloon disturbance elements are disposed in the form of a ring around the thread. In this way, the diameter of the thread balloon, and in some cases its peripheral velocity as well, are changed several times during each revolution by being caught at the disturbance elements for short time periods. The thread withdrawal speed therefore remains constant. In practice, the balloon disturbance elements are disposed in such a way that the peripheral velocity of the thread balloon is upruptly changed several times during each rotation of the balloon. The thread balloon is retarded for a short time periode, until it is abruptly accelerated again, because the thread leaves the disturbance element. In a way, the thread balloon experiences a controlled vibration and a state in which it continuously hits and slides off the disturbance elements in a controlled manner. It is thus especially advantageous if, during the formation of the balloon, the thread is alternatingly moved into vicinity of the balloon axis, and then is again brought back to the outermost edge of the balloon. The thread balloon undergoes a continuous, very fast vibration, because the rotor and therefore the thread, turn at 40,000 to 60,000 revolutions per minute, or even faster.

As a result, the desired hairiness and the desired bulkiness of the thread, are achieved. Fiber ends and fiber loops which are freed from the thread, stick out from the thread, and cause the wooly appearance of the thread which is commonly seen in ring-yarns.

Surprisingly, the after treatment of the thread occurs without an additional increase in the tension of the thread. This can be explained by the fact that the force which holds the thread back, and heretofore originated from the open end of the thread and from the deflection ring, now has its origin in the thread balloon guide according to the invention.

Thus, the thread tension between the thread withdrawal device and the thread balloon guide is not greater than the thread tension between the thread withdrawal device and the deflection ring in the previous device. However, obviously, the thread tension is also not greater between the deflection ring or the open end, respectively, and the thread balloon guide, than between thread balloon guide and the withdrawal device.

In practice, the thread balloon guide is constructed as a tubular insert in a thread drawing screw, which contains the deflection ring. In this manner, a small unit is created which can be exchanged as one piece, so that it can be exchanged if the spinning conditions are changed.

The desired after treatment of the thread is aided if the longitudinal axis of the thread balloon guide coincides with the axis of rotation of the rotor. This establishes symmetrical conditions, and an uneven treatment of the thread is avoided.

In a further development of the invention, the balloon disturbance elements are constructed as projections or raised portions which are aligned with the longitudinal axis. Therefore, the disturbance elements may be radially or even tangentially directed towards the longitudinal axis. The ends or the points of these raised portions determine the smallest possible diameter of the thread balloon. The largest possible balloon diameter is advantageously determined by providing depressions between the balloon disturbance elements. In practice, it has been found that the thread jumps into one of these depressions and then into another, or hits a disturbance element and then a depression again, always in a circle. The thread preferably falls back to the central axis of the thread withdrawal, and therefore the changes in the dimension of the thread balloon go through a zero point.

Advantageously, the system of projections and depressions is in the form of an internal gear. The points of the projections or elevations and the ends of the depressions respectively lie on an imaginary cylindrical surface. In practice, the diameter of the cylindrical surfaces are in a ratio of from 1:3 to 2:3 to each other. Naturally, the depressions must be wide enough so that there is room in them for the thread. However, they must not be much wider.

A good result in the sense of the invention is also achieved if the inner diameter of the deflection ring is somewhat greater than the distance between oppositely positioned balloon disturbance elements. Depending upon the other spinning conditions, a still better result is obtained, if the points of the projections lie on a diameter which is smaller than the inner diameter of the deflection ring, and if the ends of the depressions lie on a diameter which is greater than the inner diameter of the deflection ring. This advantage is obtained, in particular, if the thread balloon is allowed to form immediately behind the deflection ring.

In order to develop symmetrical thread withdrawal conditions, it is additionally proposed to provide a thread centering device downstream of and adjacent to the thread balloon guide, in the thread withdrawal direction, which permits the centralized withdrawal of the thread. This is especially advantageous if the thread withdrawal deviates from the axis of rotation of the rotor, i.e. the withdrawal device itself no longer lies on the rotor axis. The thread centering device need not form a special narrow passage for the thread, it is sufficient to provide a bend in the discharge tube, for example, so that its inner wall which lies toward the withdrawal side, reaches to the continuation of the projected longitudinal axis of the thread ballooning guide.

The main advantage of the invention is the achievement of the objective, which is to produce a rotor-yarn, which in appearance and handle can be compared to a ring-yarn.

Other features which are considered as characteristic for the invention are set forth in the appended claims.

Although the invention is illustrated and described herein as embodied in a method and device for increasing the hairiness and the bulkiness of a thread, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary, diagrammatic, longitudinal-sectional view of a first embodiment of the device according to the invention;

FIG. 2 is a cross-sectional view taken through the associated thread balloon guide of FIG. 1;

FIG. 3 is a fragmentary, longitudinal-sectional view of a second device according to the invention;

FIG. 4 is a cross-sectional view taken through the associated thread balloon guide of FIG. 3;

FIG. 5 is a longitudinal-sectional view of a third device according to the invention;

Figure 7:
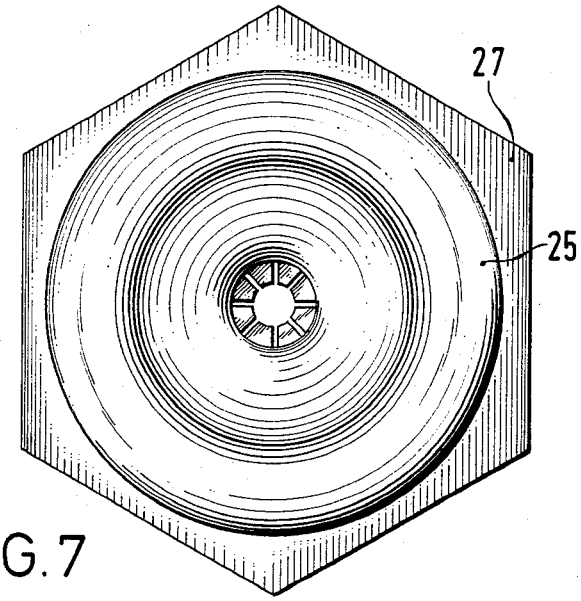
FIG. 7 is a top plan view of the device according to FIG. 6.

Referring now to the figures of the drawing in detail, and first particularly to FIG. 1 thereof, there is seen a first embodiment of the invention, having a rotor 1 of an open-end rotor spinning machine which is not further illustrated. The rotor is supplied with spinnable fibers through a fiber feed tube 2. The rotor 1 is covered toward the outside by a cover 3. The spun thread 4 is generated in a spinning groove 5 during the rotation of the rotor 1 about the axis of rotation 6 thereof. The thread 4 is continously drawn essentially along the direction of the axis of rotation of the rotor by a deflection ring 7, which is disposed concentric to the axis of rotation of the rotor. A pull-out device required for this function is formed of a pair of rollers which is not shown in FIG. 1.

The deflection ring 7 is connected by a sleeve 8 with a thread-ballooning guide 9. A thread discharge tube 10 is disposed directly downstream of the thread-ballooning guide 9. The thread discharge tube 10 slants upward, and its lower end is formed in such a way as to cause it to function as a thread centering device 11. The thread centering device 11 is constructed in such a way that the lower end of the thread discharge tube has a downwardly directed bend, and the inner wall of the thread discharge tube 10 extends from above to the longitudinal axis 6' of the thread-ballooning guide 9. The longitudinal axis 6' of the thread-ballooning guide 9 coincides with the axis of rotation 6 of the rotor 1.

The thread-ballooning guide 9 is provided with balloon disturbance or breakdown elements 12 which are distributed in a ring-shape. FIG. 1 shows that the balloon disturbance elements 12 are disposed in the middle third of the thread-ballooning guide 9.

FIG. 2 is a cross section taken through the thread-ballooning guide 9. The thread-ballooning guide 9 is constructed as a tubular insert, which is disposed in the sleeve 8. FIG. 2 shows that there are altogether twelve balloon disturbance elements provided, which in this case form raised portions in alignment with the longitudinal axis. Depressed regions or recesses 13 are disposed between the balloon disturbing elements 12. The cavities or depressed regions 13 determine the maximum balloon diameter, and provide rest positions during limited time intervals for the thread 4. FIG. 2 shows that the system of disturbance elements 12 formed of raised portions, and the depressed portions 13, have the form of an internal gear. The points of the raised portions and the ends of the depressed portions respectively lie in imaginary surfaces of a cylinder. Further explanations regarding this subject will be given below.

FIG. 1 also shows that the inner diameter of the deflection ring 7 is greater than the inner diameter of the guide 9 defined by the distance between oppositely disposed balloon disturbing elements 12. Accordingly, the points of the raised portions lie on a diameter which is smaller than the inner diameter of the deflection ring 7. However, the ends of the depressed portions 13 lie on a diameter which is greater than the inner diameter of the deflection ring 7. In this embodiment, the deflection ring 7 has a nozzle-like projection in the thread withdrawal direction.

During the spinning operation, the thread 4 forms a thread balloon 14 behind the deflection ring 7 in the thread-ballooning guide 9, at a location where the thread has lost its false twist to a great extent. With this construction, the peripheral velocity as well as the diameter of the thread balloon change several times during each revolution of the balloon. This is accomplished by the balloon disturbance elements 12. For example, the thread may be disposed in a rest position in any of the depressions 13 for a short time, which occurs abruptly. Accordingly, for a short time interval, the peripheral velocity of the thread balloon is zero. However, since the open end 15 of the thread 4 continues to rotate, the thread slides out from its rest position, approaches the longitudinal axis 6', and then travels again into a rest position in another depression for a short time. As a result of this continuous thread motion and the changing impact of the thread against the balloon disturbance elements, the desired effect of producing a hairy texture of the thread and a greater volume of the thread, are achieved.

In the second embodiment of the invention according to FIGS. 3 and 4, only the thread-ballooning guide is constructed differently than in the first embodiment. In this case, a ballooning guide 16 is provided which has a tubular shape. Balloon disturbance elements 17 are disposed in the middle third of the length of the guide 16. The balloon disturbance elements are formed of raised portions in the form of pins, which are uniformly distributed in four peripheral rows. The ends of the pins in this case also lie on a diameter which is smaller than the inner diameter of the deflection ring 7. Disposed between the individual pin-shaped raised portions are depressed portions or cavities 18, which extend to the tubular inner wall of the thread-ballooning guide 16. FIG. 3 shows that the ends of these depressed portions or recesses 18 lie along a diameter which is greater than the inner diameter of the deflection ring 7.

In the case of the third embodiment of the invention according to FIG. 5, there is provided a ballooning guide 19 which is constructed in the form of a tubular insert in a thread navel 21. The thread-ballooning guide 19 is provided with balloon disturbance elements 22, which are evenly distributed over the entire length of the periphery thereof. In this case, the ends of the balloon disturbance elements 22 also lie on an imaginary cylindrical surface having a diameter which is smaller than the inner diameter of a deflection ring 20. The thread-ballooning guide 19 is cemented or glued into a suitable hole formed in the thread navel 21. Furthermore, the deflection ring 20 is cemented or glued into a suitable recess formed in the thread navel 21. The thread navel 21 is provided with an outside thread 23 to facilitate its exchange. For example, it can be screwed into a sleeve which is provided with a cover to covering the rotor.

Figure 8:
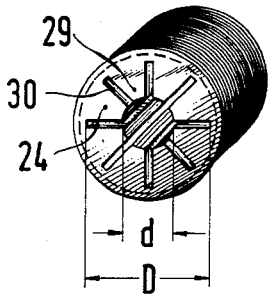
FIG. 8 is a perspective view of the thread balloon guide of the device according to FIG. 6.
Figure 6:
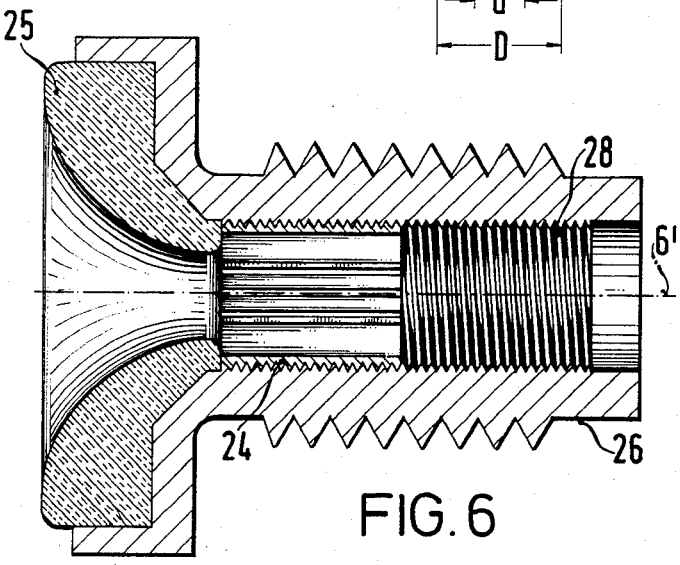
FIG. 6 is a longitudinal-sectional view of another device according to the invention.

The last embodiment according to FIGS. 6 to 8 includes a thread-ballooning guide 24 which in this case is also constructed as a tubular insert in a thread navel 26 that contains a deflection ring 25.

The thread navel 26 has a hexagonal head 27, which is provided with a recess for receiving the deflection ring 25. The thread navel 26 is provided with a central threaded hole 28 for retaining the thread-ballooning guide 24 which is provided with an outside thread. The deflection ring 25 is made of porcelain, and is cemented or glued into the thread navel 26.

The thread-ballooning guide 24, shown in a perspective view in FIG. 8, is provided with annular separated or distributed balloon disturbance elements 29. Eight similar balloon disturbance elements are provided, which extend over the entire length of the thread-ballooning guide 24. In this case as well, the thread disturbance elements 29 are constructed as raised portions which are aligned with the longitudinal axis 6' of the thread-ballooning guide 24. Recesses or depressions 30 are formed between the balloon disturbance elements 29. The recesses or depressions 30 determine the largest possible balloon diameter and the short interval rest positions for the thread. In this embodiment too, the system of raised and lowered portions takes the form of an internal gear with parallel flanks or sides.

FIG. 8 shows clearly that the ends of the raised portions as well as the ends of the depressions lie on respective imaginary cylindrical surfaces. The cylinder surface in which the ends of the raised portions or the balloon disturbance elements 29 lie, has a diameter d, and the cylindrical surface in which the ends of the depressions 30 lie, has a diameter D. The diameters of the above-mentioned cylindrical surfaces have a ratio of 1:3 to each other, i.e. the diameter D is three times as large as the diameter d.

Furthermore, the inner diameter of the deflection ring 25 is greater than the distance between respective opposite balloon disturbance elements 29. The ends of the depressions 30 lie on a diameter which is greater than the inner diameter of the deflection ring 25.

FIGS. 6 to 8 are drawn on a greatly enlarged scale. For example, in reality, the diameter d is only about 1.5 mm, while the diameter D is about 4.5 mm, and the inner diameter of the deflection ring 25 is about 2.5 mm.

The feature of the thread-ballooning guide 24 being threaded into the internal thread-bore 28 of the thread navel 26, and secured there, such as by a thermo-curing cement or heat setting adhesive, provides the possibility of adjusting the thread-ballooning guide to the most advantageous distance from the deflection ring 25.

In the embodiment used as an example, the system of projections and depressions of the balloon disturbance elements was formed by electro-erosive material removal starting from the diameter d. However, it is also possible to produce the depressions by a broaching method, or to produce the thread-ballooning guide by a die casting method, a sintered or compressed powder method, and the like.

The foregoing is a description corresponding in substance to German Application No. P 32 20 402.7, dated May 29, 1982, the International priority of which is being claimed for the instant application, and which is hereby made part of this application. Any material discrepancies between the foregoing specification and the aforementioned corresponding German application are to be resolved in favor of the latter.

We claim:

1. Method of increasing the hairiness and bulkiness of a thread, in an open-end rotor spinning machine having a deflection ring disposed concentric to the axis of rotation of the rotor, which comprises continuously withdrawing the thread through the deflection ring substantially along the direction of the axis of rotation of the rotor, forming a thread balloon with the thread having a maximum diameter larger than the inner diameter of the deflection ring, bringing the thread in contact with a multiplicity of separately disposed balloon disturbance elements, and thereby changing the diameter of the thread balloon several times during each revolution of the thread balloon.

2. Method according to claim 1, which comprises abruptly changing the peripheral velocity of the thread balloon several times during each revolution of the thread balloon.

3. Method according to claim 1, which comprises alternatingly moving the thread at least to the vicinity of the axis of the thread balloon and back to the outermost edge of the thread balloon, during the formation of the thread balloon.

4. In a device for increasing the hairiness and bulkiness of a thread in an open-end rotor spinning machine, having a rotor with an axis of rotation and a deflection ring disposed concentric to the axis of rotation of the rotor, the thread being continuously drawn through the deflection ring substantially along the direction of the axis of rotation of the rotor, the improvement comprising a thread balloon guide following said deflection ring for forming a thread balloon having a larger maximum diameter than the inner diameter of said deflection ring, said thread balloon guide having balloon disturbance elements for contacting the thread and changing the diameter of the thread balloon, said balloon disturbance elements being annularly and separately disposed in said thread guide.

5. Device according to claim 4, including a navel, said deflection ring being disposed in said navel and said thread balloon guide being in the form of a tubular insert disposed in said navel.

6. Device according to claim 4, wherein said balloon disturbance elements are in the form of projections formed on said thread balloon guide in alignment with the longitudinal axis of said thread balloon guide.

7. Device according to claim 6, wherein said thread balloon guide has depressions formed therein between said balloon disturbance elements, for determining the largest possible balloon diameter and rest positions for receiving the thread for limited durations.

8. Device according to claim 7, wherein said projections and said depressions have ends disposed on respective imaginary cylindrical surfaces, and said surfaces have diameters in a mutual ratio of between 1:3 and 2:3.

9. Device according to claim 7, wherein said deflection ring has an inner diameter larger than the distance between oppositely disposed balloon disturbance elements.

10. Device according to claim 7, wherein said deflection ring has a given inner diameter, said projections have ends lying on a diameter smaller than said given inner diameter of said deflection ring, and said depressions have ends lying on a diameter greater than said given inner diameter of said deflection ring.

11. Device according to claim 6, wherein said deflection ring has an inner diameter larger than the distance between oppositely disposed balloon disturbance elements.

12. Device according to claim 4, wherein said thread balloon guide has depressions formed therein between said balloon disturbance elements, for determining the largest possible balloon diameter and rest positions for receiving the thread for limited durations.

13. Device according to claim 4, wherein said deflection ring has an inner diameter larger than the distance between oppositely disposed balloon disturbance elements.

14. Device according to claim 4, including a thread centering device disposed along the thread withdrawal direction from said thread balloon guide, for permitting a centralized withdrawal of the thread.

* * * * *